US008376565B2

(12) United States Patent
Schrimmer et al.

(10) Patent No.: US 8,376,565 B2
(45) Date of Patent: Feb. 19, 2013

(54) ILLUMINATED GLOVE HAVING AN INNER AND AN OUTER GLOVE

(75) Inventors: Michael L. Schrimmer, Vernon Hills, IL (US); Arno Schrimmer, Northbrook, IL (US)

(73) Assignee: I Pee Holding LLC, Vernon Hills, IL (US)

( * ) Notice: Subject to any disclaimer, the term of this patent is extended or adjusted under 35 U.S.C. 154(b) by 0 days.

(21) Appl. No.: 13/252,918

(22) Filed: Oct. 4, 2011

(65) Prior Publication Data

US 2012/0081885 A1 Apr. 5, 2012

Related U.S. Application Data

(60) Provisional application No. 61/389,608, filed on Oct. 4, 2010.

(51) Int. Cl.
*F21V 21/08* (2006.01)

(52) U.S. Cl. ..... 362/103

(58) Field of Classification Search ..... 362/103
See application file for complete search history.

(56) References Cited

U.S. PATENT DOCUMENTS

| | | | | |
|---|---|---|---|---|
| 168,836 | A | 10/1875 | Hall | |
| 192,082 | A | 6/1877 | Peters | |
| 217,818 | A | 7/1879 | Price | |
| 719,352 | A | 1/1903 | Marsh | |
| 994,856 | A | 6/1911 | Mariner | |
| 2,187,430 | A | 1/1940 | Olmsted et al. | |
| 2,566,580 | A | 9/1951 | Patterson | |
| 2,702,906 | A | 3/1955 | Causse | |
| 4,107,840 | A | 8/1978 | Kupperman et al. | |
| 4,197,592 | A * | 4/1980 | Klein | 2/161.1 |
| 4,645,251 | A * | 2/1987 | Jacobs | 294/1.3 |
| D349,364 | S | 8/1994 | Rasmussen | |
| 5,467,484 | A * | 11/1995 | Drescher et al. | 2/161.8 |
| 5,580,154 | A | 12/1996 | Coulter et al. | |
| 5,782,516 | A | 7/1998 | Partida | |
| 6,006,357 | A * | 12/1999 | Mead | 2/160 |
| 6,374,417 | B1 | 4/2002 | Stagnitta | |
| 6,709,142 | B2 * | 3/2004 | Gyori | 362/554 |
| 7,401,937 | B2 * | 7/2008 | Abas | 362/103 |
| 7,503,667 | B2 * | 3/2009 | Wilkings | 362/103 |
| D600,411 | S | 9/2009 | O'Reilly | |
| 7,597,449 | B2 * | 10/2009 | Stokes | 362/103 |
| 7,891,831 | B2 * | 2/2011 | Chen | 362/103 |
| D640,856 | S | 7/2011 | Rose | |
| 2006/0139911 | A1 | 6/2006 | Wilkings | |
| 2011/0049117 | A1 * | 3/2011 | Macher et al. | 219/211 |

OTHER PUBLICATIONS

Light Up LED Silver Sequin Gloves, [on-line]; [downloaded from Internet Feb. 8, 2012]; URL: <http://litebrightraves.com/light-up-gloves/light-up-led-silver-sequin-gloves/>.

(Continued)

*Primary Examiner* — Robert May
(74) *Attorney, Agent, or Firm* — Levenfeld Pearlstein, LLC

(57) ABSTRACT

Illuminated clothing accessories are disclosed. A glove includes a glove, light emitting elements disposed proximate finger tips of the glove, a controller coupled to the light emitting elements to control illumination thereof, a power supply coupled to the controller, and light reflecting elements disposed on a top surface of the glove. A headpiece includes a front panel on a top portion of the headpiece. The headpiece includes a top portion having a plurality of light emitting elements arranged thereon. A rim is connected to a bottom end of the top portion. A controller is coupled to the light emitting elements to control illumination thereof. A power supply is coupled to the controller and the plurality of light reflecting elements are disposed on the top portion and the rim of the headpiece.

18 Claims, 7 Drawing Sheets

OTHER PUBLICATIONS

NL LED Gloves, [on-line]; [downloaded from Internet 02-08-2-12]; URL: <http://www.nitelifetshirts.com/nl-led-gloves-c-10.html>.

Silver Sequin Glove, [on-line]; [downloaded from the Internet Feb. 8, 2012]; URL: <http://www.spirithalloween.com/product/sequin-white-glove/>.

* cited by examiner

ILLUMINATED GLOVE HAVING AN INNER AND AN OUTER GLOVE

CROSS-REFERENCE TO RELATED APPLICATIONS

The present application contains subject matter related to that disclosed in U.S. Provisional Application No. 61/389,608, tiled "ILLUMINATED GLOVE," filed in the United States Patent and Trademark Office on Oct. 4, 2010, the entire contents of which are hereby incorporated by reference.

BACKGROUND OF THE DISCLOSURE

1. Field of the Invention

The present disclosure relates generally to a clothing accessory and, more particularly, to gloves and hats with one or more lighting elements associated therewith.

2. Description of the Background

Novelty items and party supplies come in a wide variety to suite any type of theme, special occasion, or seasonal event. One category of novelty item includes items that glow or otherwise emit light. Such glow or light emitting items include light sticks, fiber optic wands, light emitting diode ("LED") ice cubes, flashing jewelry, and glow or illuminated necklaces, bracelets, sunglasses, and other forms of apparel.

In one example, gloves, hats or other clothing accessories with one or more lighting emitting elements are generally known and available to the public. However, the purchasing public is constantly attracted to new and unique novelty items and party supplies.

SUMMARY OF THE DISCLOSURE

According to one example, an illuminated glove includes a glove, light emitting elements disposed proximate finger tips of the glove, a controller coupled to the light emitting elements to control illumination thereof, a power supply coupled to the controller, and light reflecting elements disposed on a top surface of the glove.

According to another example, an illuminated glove includes an inner glove disposed within an outer glove and light emitting elements disposed proximate each fingertip between the inner and outer gloves. Each light emitting element includes three light emitting diodes that each emits light in a different color. The glove further includes a controller coupled to the light emitting elements to control illumination thereof, a power supply coupled to the controller, and light reflecting elements disposed on a top surface of the outer glove. In still another embodiment, light emitting units and light reflecting units are aligned on or in a headpiece or a hat.

BRIEF DESCRIPTION OF THE DRAWINGS

Other aspects and advantages of the present disclosure will become apparent upon reading the following detailed description and upon reference to the drawings in which.

DETAILED DESCRIPTION

Figure 1:
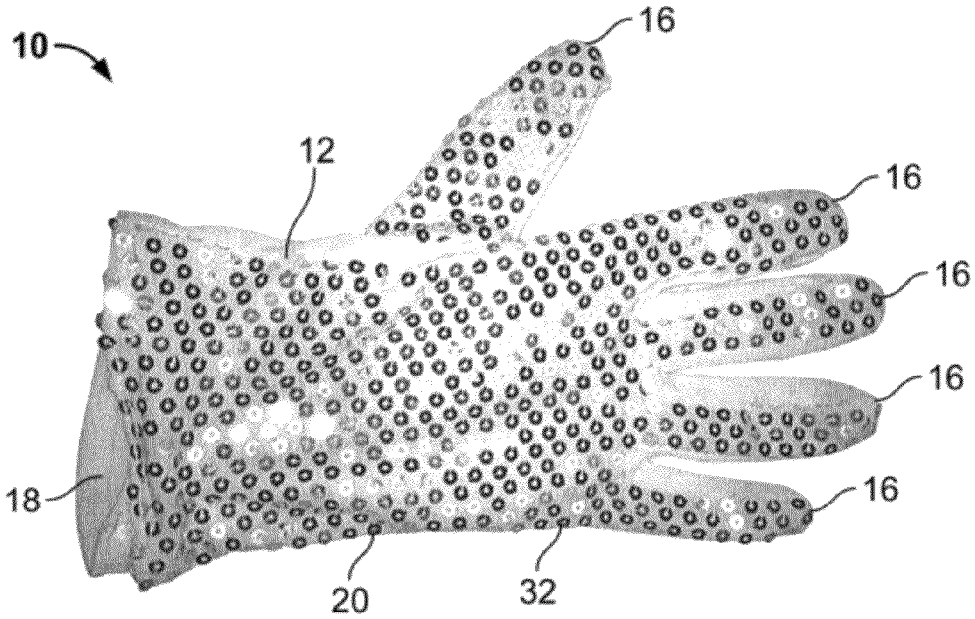
FIG. 1 is a top view of an illuminated glove according to one example.

While the present disclosure is susceptible of implementation in various forms, there is shown in the drawings and will hereinafter be described one or more examples with the understanding that the present disclosure is not intended to limit the disclosure to the specific examples illustrated and discussed.

Figure 2:
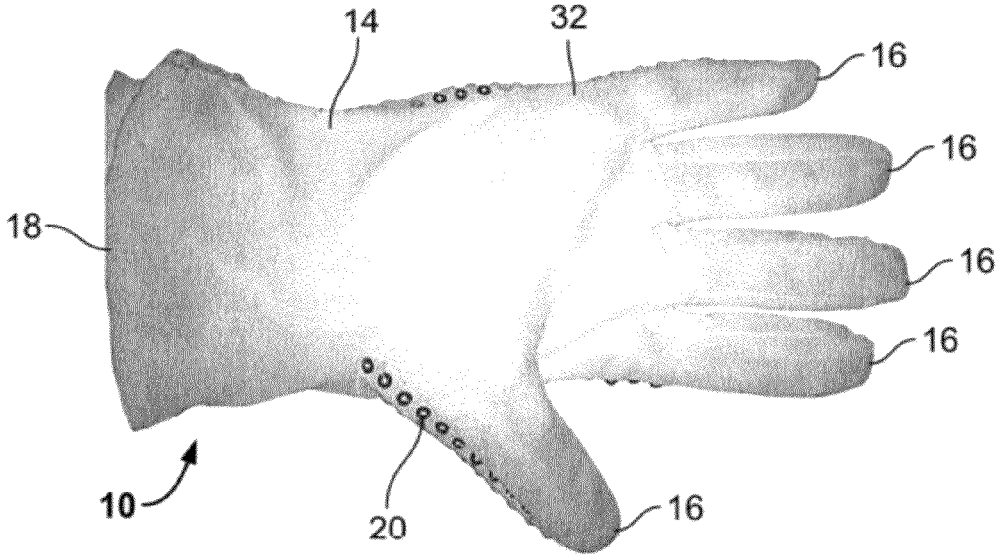
FIG. 2 is a bottom view of the glove of FIG. 1.

Referring to FIGS. 1 and 2, the present disclosure is directed to a glove 10, among other items, that includes a top surface 12 and a bottom surface 14. The glove 10 further includes fingers 16 and an opening 18 that allows a user to insert a hand therein. Still further, the glove 10 includes a plurality of light reflecting elements 20 disposed on a surface thereof. In the present example, the light reflecting elements 20 include a plurality of sequins spaced apart and disposed on the top surface 12. In other examples, the light reflecting elements 20 can include other known reflective, glittery, or mirror-like elements and can be disposed on the top and/or bottom surfaces 12, 14. Further, the glove 10 is configured to accommodate a left hand or a right hand and is made from any material suitable for wearing on a hand including, but not limited to cotton or polyester cloth. In one example, the glove 10 is made from a white cloth, which along with the light reflective elements 20, improves the visual effect of the glove when it is illuminated in a dark room, for example.

Figure 3:
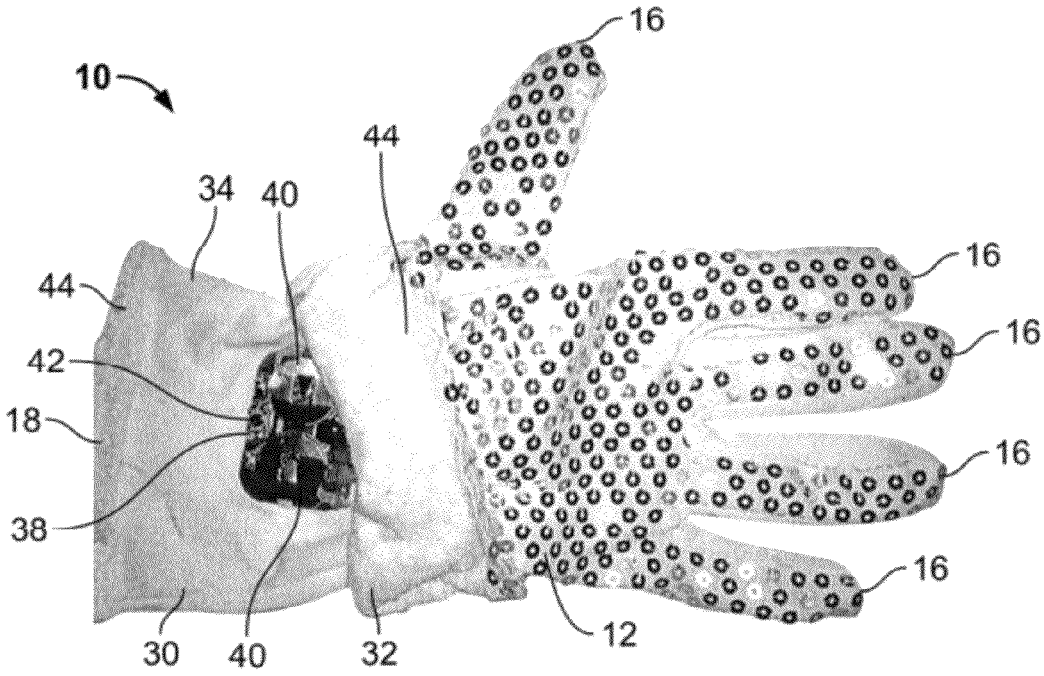
FIG. 3 is a top view of the glove of FIG. 1 with an outer glove pulled away to expose portions of an inner glove.
Figure 4:
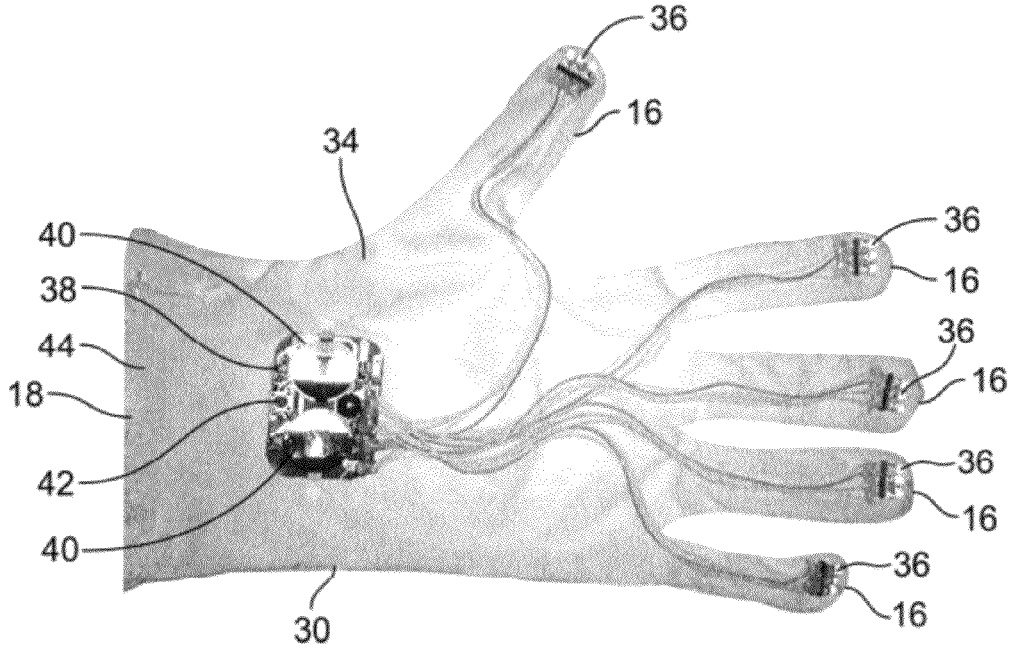
FIG. 4 is a top view of the inner glove of FIG. 3.

With reference to FIGS. 3 and 4, the glove 10 further includes an inner glove 30 disposed within an outer glove 32. The inner glove 30 includes a top surface 34 and a bottom surface (not shown), with the bottom surface of the inner glove 30 being in contact with the hand of the user. The outer glove 32 includes the top surface 12 and the bottom surface 14 with the bottom surface 14 of the outer glove 32 being in contact with the top surface 34 of the inner glove 30. In one example, the outer glove 32 is made from a semitransparent material. In another embodiment, the top surface 34 of the inner glove 30 is coated with a reflective material. In yet another embodiment, the top surface 12 of the outer glove 32 is comprised of a material which focuses or diffracts the light emitted from the plurality of light emitting elements 36.

The glove 10 also includes a controller 38 coupled to each of the light emitting elements 36, with the controller 38 including a power supply 40, a user input unit 42 and a signal control unit 44. In the present embodiment, the light emitting elements 36 and the controller 38 are disposed between the inner and outer gloves 30, 32 and may be attached to one or both of the inner and outer gloves 30, 32.

In one example, the light emitting elements 36 are on the proximate distal tips of the fingers 16 of the glove between the inner glove 30 and outer glove 32. In another example, the light emitting elements 36 are arranged between the inner glove 30 and the outer glove 32 along a central axis of each finger. In another example, the light emitting elements 36 are arranged across the entire top surface 34 of inner glove 30. In another example, the light emitting elements 36 may be arranged such that some light emitting elements 36 are positioned between the inner glove 30 and outer glove 32 while other light emitting elements 36 are positioned on the top surface 12 or bottom surface 14 of the outer glove 32. In another example, the light emitting elements 36 are arranged such that the illuminations of specific light emitting elements 36 form a shape or a letter. In yet another example, the light emitting elements 36 are light emitting diodes ("LED's"). In another example, the light emitting elements 36 are grouped together based on color. In another example, the light emitting elements 36 are grouped into groups of three light emitting elements with each group including at least one blue light emitting element 36, at least one red light emitting element 36 and at least one green light emitting element 36. In another embodiment, the light emitting elements 36 in each group are arranged according to the color of each light emitting element 36.

Consistent with the present embodiment, the controller 38 is affixed to the top surface 34 of the inner glove 30 or to the bottom surface 16 of the outer glove 32. This arrangement provides a secure and comfortable configuration for the various components of the glove 10. In one embodiment, the controller 38 may be sealed by a covering to prevent water and contaminants from making contact with the controller 38. The controller 38 may be sealed using plastic, epoxy or any other material capable of creating a barrier that prevents contaminants from contacting the controller 38. In one example, the controller 38 is electrically coupled to the light emitting elements 36 by a plurality of conductors such as, but not limited to, wires to control illumination of each light emitting element 36. In another example, the controller is coupled to the light emitting elements 36 by a plurality of light conductors such as, but not limited to, a fiber optic cable.

The glove 10 may further include an attachment unit which secures the inner glove 30 to the outer glove 32. In one example, the attachment unit is positioned at the end of the glove furthest from the distal ends of the fingers. In one example, the attachment unit includes opposing hook and loop type fasteners 44 disposed on the inner and outer gloves 30, 32. In another example, the attachment unit includes other elements such as, but not limited to, an adhesive, a sewn thread, or any other material or apparatus capable of attaching the inner glove 30 to the outer glove 34. In another example, the attachment unit creates an airtight seal between the inner glove 30 and the outer glove 34. Consistent with this example, the inner glove 30 and outer glove 32 are fabricated from a material which prevents fluid, such as air or water, from entering or exiting the glove such as, but not limited to rubber.

Figure 6A:
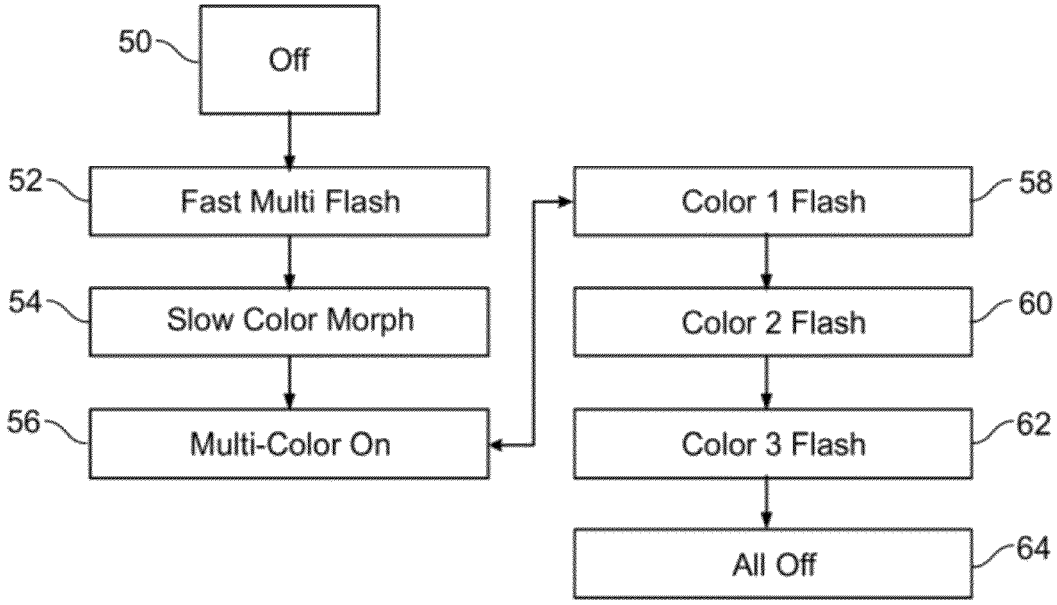
FIG. 6A depicts one example of the controller that controls the operation of the light emitting elements.

FIG. 6A depicts one example of the controller 38 that controls the operation of the light emitting elements 36. The controller 38 includes the power supply unit 40, the user input unit 42 and the signal control unit 44. The signal control unit 44 is electrically coupled to a plurality of light emitting elements 36. In one example, the signal control unit 44 is electrically coupled to each light emitting device 36 individually. In another example, the signal control unit 44 is electrically coupled to groups of light emitting device 36. In another example, the light emitting elements 36 in each group are wired in series with the control unit 44. In another example, each group of light emitting elements 36 is wired in parallel to each other. In one example, the user input switch 42 is a push button toggle switch. In one example, the power supply unit comprises at least one battery. Consistent with this embodiment, the battery has an operating voltage of, for example, 3 volts, 9 volts or 12 volts.

Figure 5:
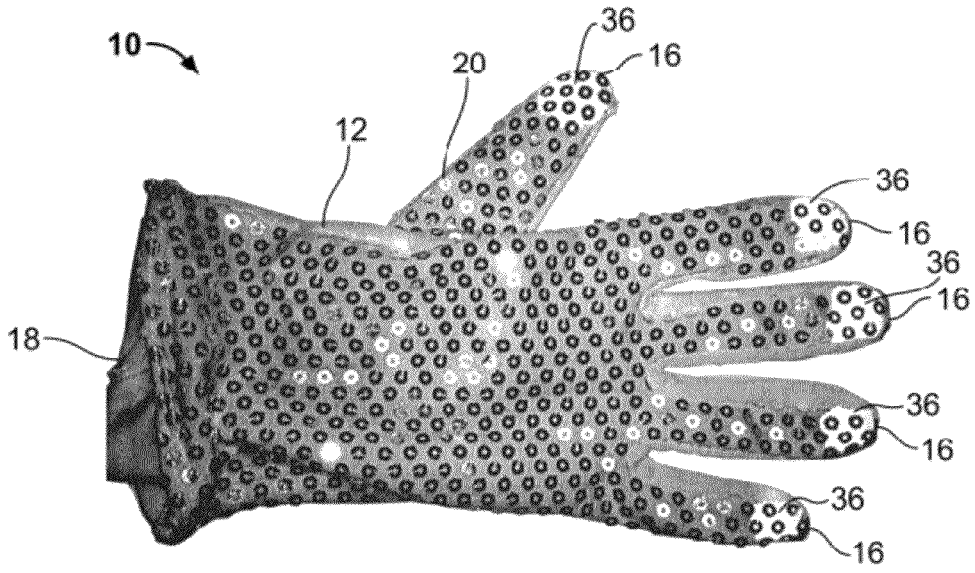
FIG. 5 is a top view of the glove of FIG. 1 with light emitting elements illuminated.

The signal control unit 44 is configured to receive a power signal from the power supply unit 40 and a mode changing signal from the user input device 42. The signal control unit 44 is further configured to adjust output signals sent to each light emitting device 36 based on the mode changing signal received from the user input device 42. For example, FIG. 1 illustrates one mode of operation where signal control unit transmits an output signal causing each of the light emitting elements 36 to turn off and FIG. 5 illustrates another mode of operation where signal control unit transmits an output signal causing each of the light emitting elements 36 to turn on. In one illustrative example, when the light emitting elements 36 are in an "ON" mode, a wearer of the glove can create a mesmerizing light show in a dark room, wherein the light reflecting elements 20 enhance the effect by reflecting light from the elements 36 and the surrounding environment.

In another mode of operation, the user input device 42 sends a fast multi-flashing mode signal to the signal control unit 44. In the fast multi-flashing mode, the signal control unit 44 sends timed output signals to predefined light emitting elements 36 causing the light emitting elements 36 to alternately illuminate in relation to one another. In another mode of operation, the user input device 42 sends an "all on" signal to the signal control unit 44 and the signal control unit 44 transmits a signal to each light emitting element 36 to fully illuminate. In another example, the signal control unit 44 may vary one component of the output signal transmitted to the light emitting elements 36 such that the level of illumination of each light emitting element 36 modulates between full illumination and the lowest possible level of illumination over a predetermined time period.

In one example, the signal control unit 44 varies the voltage of the output signal over a period of time from a beginning voltage to an end voltage to control the illumination level of each light emitting element 36. In another example, the signal control unit 44 may provide an electrical signal to groups of light emitting elements 36 over a variable period of time. In another example, the signal control unit 44 may send an output signal to the light emitting elements 36 in a first group for a first time period before sending a separate output signal to a second group of light emitting elements 36 for a second period of time. In one embodiment, the signal control unit 44 sequentially sends output signals to each group of light emitting elements 36.

As an illustrative example, the signal control unit 44 sends an output signal to each red light emitting element 36 causing each red light emitting element 36 to emit a low level of red light. The signal control unit 44 then increases the output signal to the red light emitting elements 36 over a first predetermined time until the red light emitting elements 36 reach a maximum illumination level. Once the maximum illumination output is transmitted, the signal control unit 44 reduces the output signal transmitted to the red light emitting elements 36 over a second predetermined time until the output signal reaches the off level for the red light emitting elements 36. Just before the red light emitting elements 36 reach the off level, the signal control unit 44 transmits a low illumination output signal to the blue light emitting elements 36 and the process continues in the same manner for the blue light emitting elements 36.

Figure 6B:
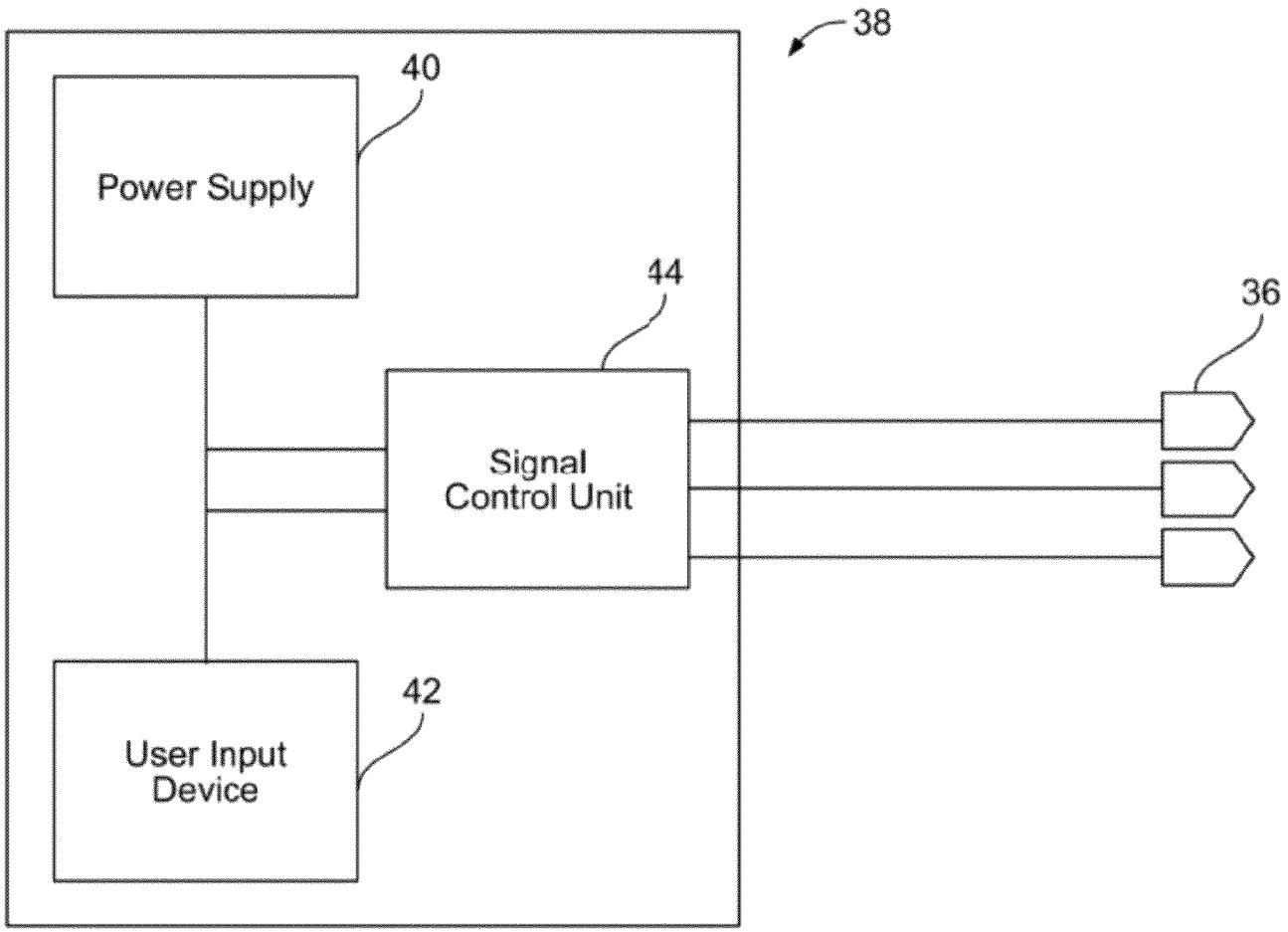
FIG. 6B shows one configuration of the controller used in the glove of FIG. 1.

FIG. 6B depicts a schematic representation of one embodiment of the operation of the controller. At block 50, the glove 10 is in the off mode and the signal control unit 66 does not send any output signals to the light emitting devices 36. In block 52, the user input device 42 transmits a first change of mode signal to the controller 38 which illuminates the light emitting elements 36 in a first mode of operation. The fast multiple light flashing mode continues until the signal control unit 44 receives a second change of mode signal from the user input device 42.

Upon receipt of a second change of mode signal from the user input device 42, the signal control unit 44 sends an output signal to a plurality of light emitting elements 36, or groups of light emitting elements 36, that have the same color causing a plurality of light emitting elements 36 of the same color to simultaneously illuminate, as shown in block 54. In yet another embodiment, the signal control unit 44 varies the intensity of the output signal such that the light emitting elements 36 receiving the signal appear to fade in and out as a new output signal is generated by the signal control unit 44.

Upon receipt of a third change of mode signal from the user input device 42, the signal control unit 44 transmits an output signal to a plurality of light emitting elements 36, or group of light emitting elements 36, which cause at least two light emitting elements 36 of different colors to display on the glove 10 simultaneously, as shown in block 56. Upon receipt of a fourth change of mode signal from the user input device 42, the signal control unit 44 transmits a signal to a plurality of light emitting elements 42 of the same color such that the light emitting elements 36 flash in unison, as shown in block 58. In another embodiment, the signal control unit 44 transmits a signal which causes a plurality of light emitting elements 36 of the same color to flash in a predetermined pattern.

Upon receipt of the fifth change of mode signal, the signal control unit 44 transmits a signal to a plurality of light emitting elements 42 of a same color, but a different color than the color illuminated under the fourth change of mode signal, such that the light emitting elements 36 flash in unison, as shown in block 60. In another embodiment, the signal control unit 44 transmits a signal which causes the light emitting elements 36 of the same color to flash in a predetermined pattern, Upon receipt of a sixth change of mode signal from the user input device 42, the signal control unit 44 transmits a signal to a plurality of light emitting elements 42 of the same color, but a color different than the color illuminated by the fourth and fifth change of mode signals, such that the light emitting elements 36 flash in unison, as shown in block 62. In another embodiment, the signal control unit 44 transmits a signal which causes the light emitting elements 36 of the same color to flash in a predetermined pattern. Upon receipt of the seventh change of mode signal from the user input device 42, the signal control unit 44 turns off all of the light emitting elements.

Figure 7A:
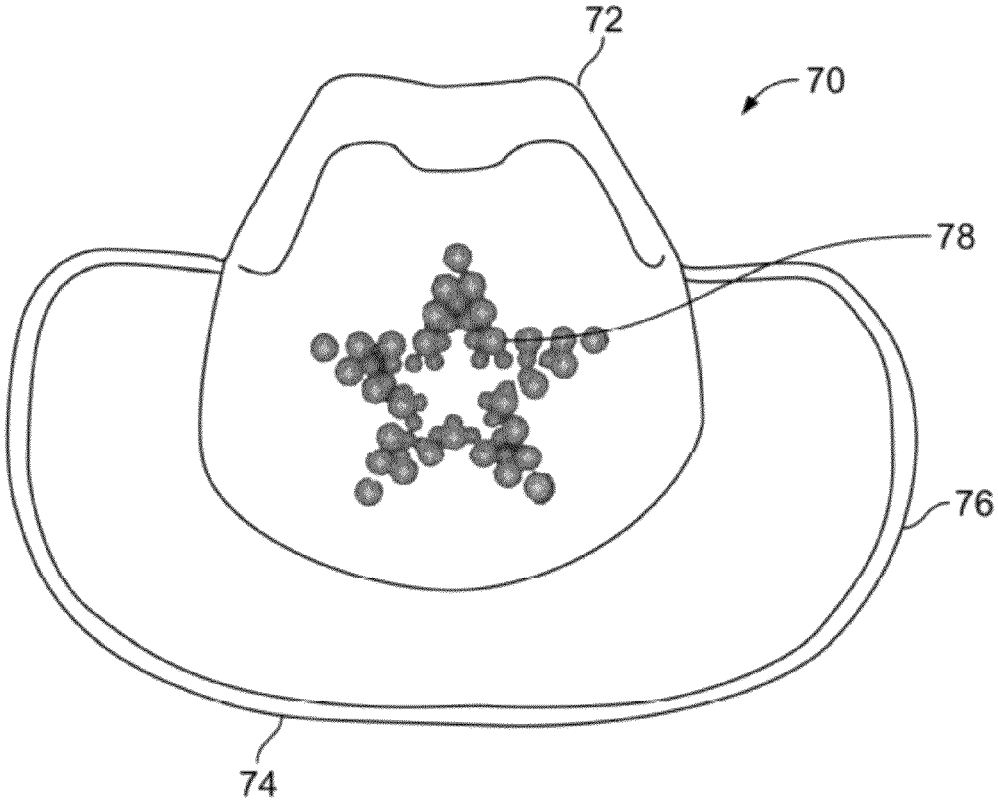
FIG. 7A depicts one configuration of a headpiece that is consistent with the present invention.

FIG. 7A depicts one embodiment of a headpiece 70, or hat, that is consistent with the present invention. The headpiece 70 includes a top piece 72, a bottom opening 74, a rim 76, and a front panel 78. The front panel 78 extends from the bottom opening 74 to the upper portion of the top piece 72. In one example, the front panel 78 extends around the entire top piece 72. In another example, the front panel 78 covers a front facing portion of the headpiece 70. In another example, the rim 76 extends around the entire circumference of the bottom opening 74.

Figure 7B:
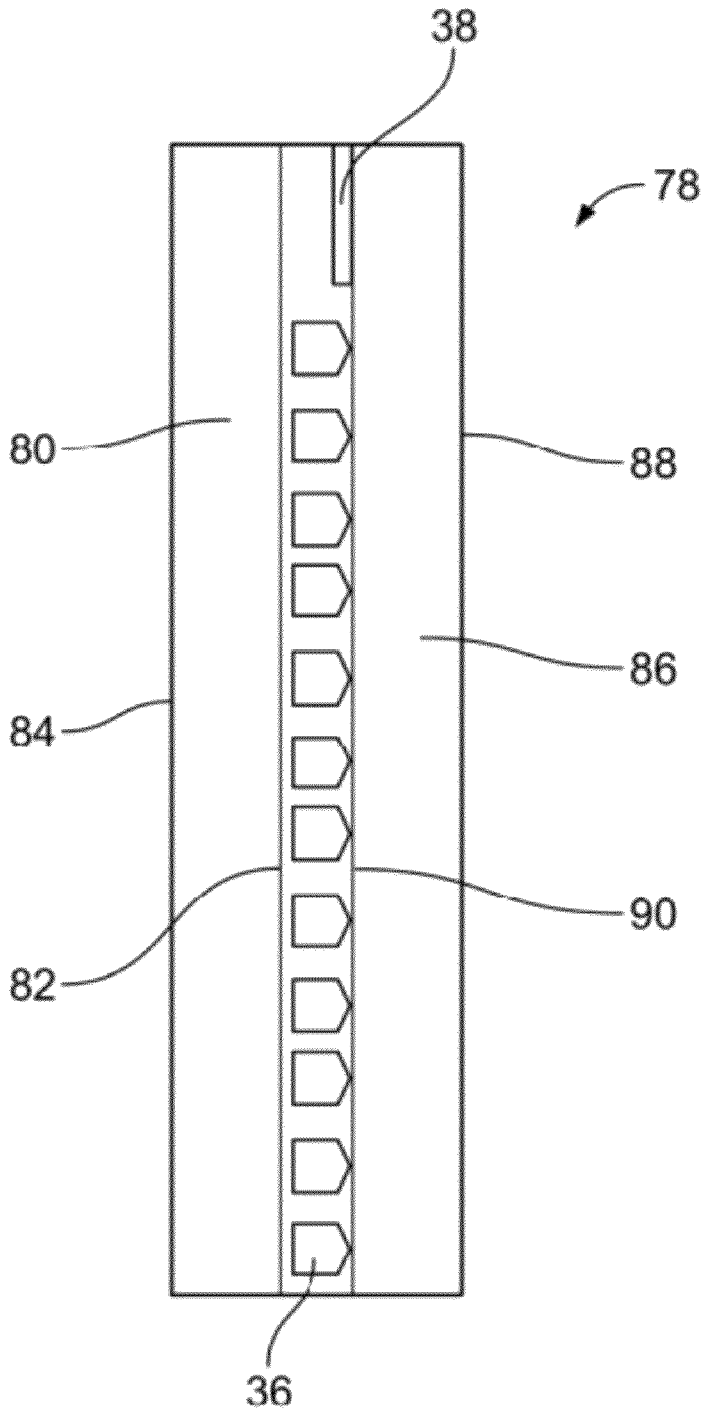
FIG. 7B depicts one configuration of the front panel of the headpiece of FIG. 7A.

FIG. 7B depicts one embodiment of the front panel 78 of the headpiece 70. The front panel 78 includes an inner layer 80 having a top surface 82 and a bottom surface 84 and an outer layer 86 having a top surface 88 and a bottom surface 90. In one example, the plurality of light emitting elements 36 are secured to the top surface 82 of the inner layer 80 or the bottom surface 84 of the outer layer 86. Consistent with this embodiment, the outer layer 86 is made from a material which partially transmits light from the light emitting elements 36. In one embodiment, the top surface 82 of the inner layer 80 is comprised of a material that reflects, or at least partially reflects, light. In another example, the outer layer 86 is formed from a plurality of lenses capable of redirecting light from the light emitting elements 36. In another embodiment, the light emitting elements 36 are secured to the top surface of the outer layer 86. In yet another embodiment, the material of the outer layer 86 over each of the light emitting elements 36 is removed to expose the light emitting elements 36. In still another embodiment the opening created by removing the material over the light emitting elements 36 is coated with a light reflective material.

Figure 7C:
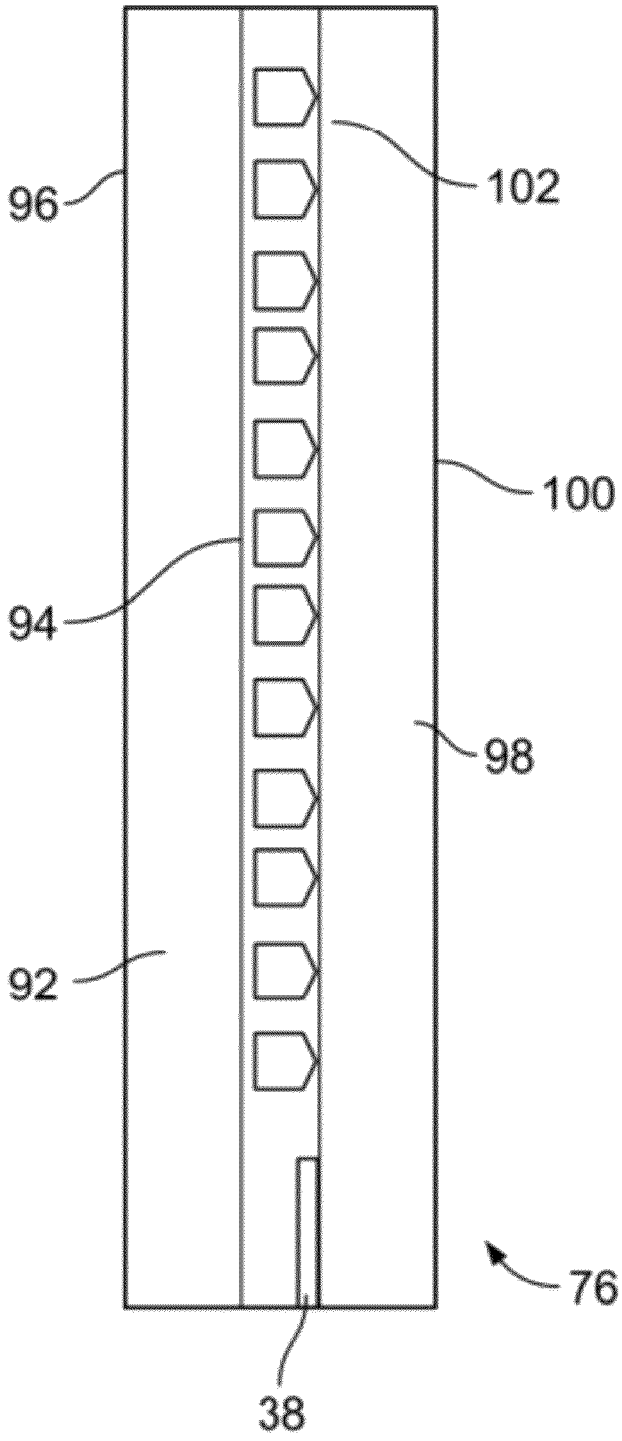
FIG. 7C depicts one configuration of the rim of the headpiece of FIG. 7A.

FIG. 7C depicts one embodiment of the rim 76 of a headpiece 70. The rim 76 includes an inner layer 92 having a top surface 94 and a bottom surface 96 and an outer layer 98 having a top surface 100 and a bottom surface 102. In one example, the plurality of light emitting elements 36 are secured to the top surface 94 of the inner layer 92 or the bottom surface 102 of the outer layer 98. Consistent with this embodiment, the outer layer 98 is made from a material which partially transmits light from the light emitting elements 36. In one embodiment, the top surface 94 of the inner layer 92 is fabricated from a material that reflects, or at least partially reflects, light. In another example, the outer layer 98 if formed of a material which focuses or diffracts the light emitted from the light emitting elements 36.

A controller 38 is positioned on the headpiece 70 to control the operation of the light emitting elements 36 in the same manner as previously discussed. In one example, the controller 38 is positioned between the inner layer 80 and outer layer 86 of the front panel. In another example, the controller is positioned between the inner layer 92 and outer layer 98 of the rim 76.

In one example, the light emitting elements 36 are arranged on the front panel 78 such that words or images, or a plurality of words or images, are displayed when specific light emitting elements 36 are illuminated. In one embodiment, lights emitting elements 36 of different colors form different shapes on the headpiece 70. As with the glove 10 of FIGS. 1-5, the headpiece 70 may also include sequins or another light reflecting material on the top piece or rim, or around the bottom opening, of the headpiece 70 or hat. In addition, the light emitting elements on the headpiece 70 can be controlled in the same, or similar, manner as the light emitting elements 36 on the glove 10.

In another embodiment, the headpiece 70 is any one of a baseball or trucker style hat, a fedora hat, a bowler hat, western style hat such as a cowboy hat, a skull cap, a pirate hat, a jester hat, an elf hat, a top hat, a dragon shaped hat, a wizard hat or any other shape of headpiece which can be worn on a person's head. In other embodiments, other modes or even fewer modes in any sequence may be implemented without departing from the spirit of the present disclosure. Other embodiments include all of the various combinations of individual features of each of the embodiments described herein.

In the disclosure, the words "a" or "an" are to be taken to include both the singular and the plural. Conversely, any reference to plural items shall, where appropriate, include the singular.

From the foregoing, it will be observed that numerous modification and variations can be effectuated without departing from the true spirit and scope of the novel concepts of the present disclosure. It is to be understood that no limitation with respect to the specific embodiments presented is intended or should be inferred. The disclosure is intended to cover by the appended claims all such modifications as fall within the scope of the claims.

The invention claimed is:

1. An illuminated glove, comprising:

a first glove having a top surface and an interior surface, and a body formed from a semitransparent material;

an inner glove disposed within the first glove;

a plurality of light emitting elements positioned adjacent the interior surface of the first glove, and configured to transmit light through the semitransparent body of the first glove;

a controller coupled to the light emitting elements to control illumination thereof;

a power supply coupled to the controller; and a plurality of light reflecting elements disposed on the top surface of the first glove, wherein the light emitting elements and the controller are attached to a top surface of the inner glove, and arranged adjacent the interior surface of the first glove.

2. The glove of claim 1, wherein the light emitting elements are disposed proximate each finger tip of the glove.

3. The glove of claim 1, wherein each light emitting element includes three light emitting diodes ("LED's") and each LED is controlled to emit light in a different color.

4. The glove of claim 1, further comprising means for attaching the inner glove to the first glove.

5. The glove of claim 4, wherein the means for attaching includes a hook-and-loop type fastener.

6. The glove of claim 1, wherein the controller includes a switch depressible by a user to control illumination of the light emitting elements in multiple modes.

7. The glove of claim 6, wherein the modes include a fast-multiple light flashing mode, a slow multiple light transition mode, an all on mode, a first color flashing mode, a second color flashing mode, a third color flashing mode, and off.

8. The glove of claim 7, wherein the first color is blue, the second color is red, and the third color is green.

9. The glove of claim 1, wherein the light reflecting elements include sequins spaced apart and disposed only on the top surface of the first glove.

10. The glove of claim 1, wherein the first glove is made from a flexible material.

11. The glove of claim 1, wherein the first glove is made from a white polyester cloth.

12. The glove of claim 1, wherein the light emitting elements are light emitting diodes.

13. An illuminated glove, comprising:

an inner glove disposed within an outer glove, the outer glove having a body formed from a material that at least partially transmits light;

a plurality of light emitting elements disposed proximate each fingertip between the inner and outer gloves, the plurality of light emitting elements transmitting light through the body of the outer glove, wherein each light emitting element includes three light emitting diodes that each emits light in a different color;

a controller coupled to the light emitting elements to control illumination thereof;

a power supply coupled to the controller; and a plurality of light reflecting elements disposed on a top surface of the outer glove, wherein the light emitting elements and the controller are attached to a top surface of the inner glove.

14. The glove of claim 13, further comprising means for attaching the inner glove to the outer glove.

15. The glove of claim 13, wherein the controller includes a switch depressible by a user to control illumination of the light emitting elements in multiple modes.

16. The glove of claim 15, wherein the modes include a fast-multiple light flashing mode, a slow multiple light transition mode, an all on mode, a first color flashing mode, a second color flashing mode, a third color flashing mode, and off.

17. The glove of claim 13, wherein the light reflecting elements include sequins spaced apart and disposed only on the top surface of the outer glove.

18. The glove of claim 13, wherein one or both of the inner glove and the outer glove is made from a white flexible cloth.

* * * * *